US007600863B2

(12) United States Patent
Brick et al.

(10) Patent No.: US 7,600,863 B2
(45) Date of Patent: Oct. 13, 2009

(54) INKJET JET STACK EXTERNAL MANIFOLD

(75) Inventors: Jonathan Robert Brick, Tualatin, OR (US); Jim Stevenson, Tualatin, OR (US); John Richard Andrews, Fairport, NY (US); Richard Schmachtenberg, III, Aloha, OR (US); Dan Leo Massopust, Powell Butte, OR (US); Sharon S. Berger, Canby, OR (US); Terrance L. Stephens, Molalla, OR (US); Chad Johan Stenes, Sherwood, OR (US)

(73) Assignee: Xerox Corporation, Norwalk, CT (US)

( * ) Notice: Subject to any disclaimer, the term of this patent is extended or adjusted under 35 U.S.C. 154(b) by 308 days.

(21) Appl. No.: 11/326,030

(22) Filed: Jan. 4, 2006

(65) Prior Publication Data

US 2007/0153065 A1 Jul. 5, 2007

(51) Int. Cl.
*B41J 2/175* (2006.01)

(52) U.S. Cl. ..... 347/86; 347/87

(58) Field of Classification Search ..... 347/20, 347/43, 63, 65, 66, 85

See application file for complete search history.

(56) References Cited

U.S. PATENT DOCUMENTS

| | | | | |
|---|---|---|---|---|
| 6,068,370 | A * | 5/2000 | Miller et al. | 347/85 |
| 6,139,674 | A * | 10/2000 | Markham et al. | 156/252 |
| 6,229,114 | B1 | 5/2001 | Andrews et al. | |
| 6,488,368 | B2 * | 12/2002 | Petersen et al. | 347/85 |
| 2006/0284914 | A1 * | 12/2006 | Murakami et al. | 347/17 |

FOREIGN PATENT DOCUMENTS

| | | |
|---|---|---|
| EP | 0 925 923 | 6/1999 |
| WO | 01/89849 | 11/2001 |

* cited by examiner

*Primary Examiner*—Anh T. N. Vo
(74) *Attorney, Agent, or Firm*—Marger Johnson & McCollom, P.C.

(57) ABSTRACT

An inkjet external ink manifold is provided that allows for use of a jet stack that does not internally contain ink manifolds. The external ink manifold has a manifold body that includes one or more ink manifold chambers and includes ports arranged to connect the chambers to one or more ink reservoirs. The external ink manifold further includes an adhesive layer overlying and sealing the ink manifold chambers. The adhesive layer includes a plurality of ports arranged to connect the external ink manifold chambers to the jet stack.

8 Claims, 3 Drawing Sheets

INKJET JET STACK EXTERNAL MANIFOLD

BACKGROUND

The present disclosure relates to inkjet printing, and more particularly toward an inkjet printhead useful in ejecting non-water-based inks in an imagewise fashion.

In current inkjet printers, an inkjet jet stack is made up of 16-20 gold-plated stainless steel plates that are brazed together. Cavities etched into each plate align to form channels and passageways for containment of ink for each individual jet. Larger cavities align to form larger passageways that run the length of the jet stack. These larger passageways are ink manifolds arranged to supply ink to individual jets for each color of ink. Up to eight of these plates are used to create these manifolds to ensure a large enough cross-section to avoid ink starvation of the individual jets when writing solid colors while keeping the manifold internal to the jet stack.

The word "printer" as used herein encompasses any apparatus, such as digital copier, bookmaking machine, facsimile machine, multi-function machine, etc. which performs a print outputting function for any purpose. Including chemical and bio assay printed thin film devices, three-dimensional model building devices and other applications.

To increase printing speed, the number of jets may be increased within a jet stack and firing frequency of the jets may be increased. Increasing the number of jets and firing frequency using the above-described ink manifold design would require increasing the size of the ink manifold which, in turn, means using more plates to achieve a large enough cross-section. Individual gold-plated stainless steel plates are expensive, so increasing the number of plates quickly increases the cost of the jet stack.

Typically there are four ink colors used within a jet stack. The ink jets for each color are widely distributed across the face of the jet stack. The passageways from each ink manifold follow paths to the widely distributed individual jets and cross above and below each other, which adds to the height of the jet stack requiring more plates. This geometry necessary within the stack also makes the passageways from the manifolds to the individual jets relatively long and circuitous which adds drag to the ink flow, limiting the mass throughput of ink to the individual jets.

SUMMARY OF THE DISCLOSURE

As described herein, an inkjet external ink manifold includes a manifold body that includes one or more ink manifold chambers and includes ports arranged to connect the chambers to one or more ink reservoirs. An adhesive layer that includes a plurality of ports arranged to connect the chambers to a jet stack overlies and seals the one or more ink manifold chambers.

An external inkjet manifold may be used in an inkjet printhead as described herein. The printhead includes a jet stack comprising a plurality of stacked plates. The stacked plates include a bottom plate with a plurality of inkjets, a top plate with a plurality of rows of inlet ports connected to the inkjets. The print head further includes an external ink manifold in fluid communication with one or more ink reservoirs and in fluid communication with the plurality of rows of inlet ports.

DETAILED DESCRIPTION

In solid ink inkjet printers, solid ink is melted and fed to a printhead that transfers the melted ink imagewise onto an intermediate image drum. The image is then transferred from the drum to print media rolled against the drum. Within the printhead, different colored melted ink is supplied to inkjets on a face of the printhead through channels formed of aligned etched cavities in a stack of plates. To ensure proper mass flow to each inkjet, the printhead typically includes manifolds that hold melted ink and ensure enough ink mass can be provided to each inkjet. As described herein, removing the manifold from within the stack of plates to an externally fitted manifold allows for a decrease in the number of plates needed for the printhead.

While the arrangement and system described herein are advantageous for solid ink inkjet printers, it is contemplated that the external ink manifold 20 may be also be used in other types of ink printers including water-based ink printers and printers with thermally activated printheads. The external ink manifold 20 is advantageous for any ink distribution system that may utilize printheads made from stacked plates.

Figure 1:
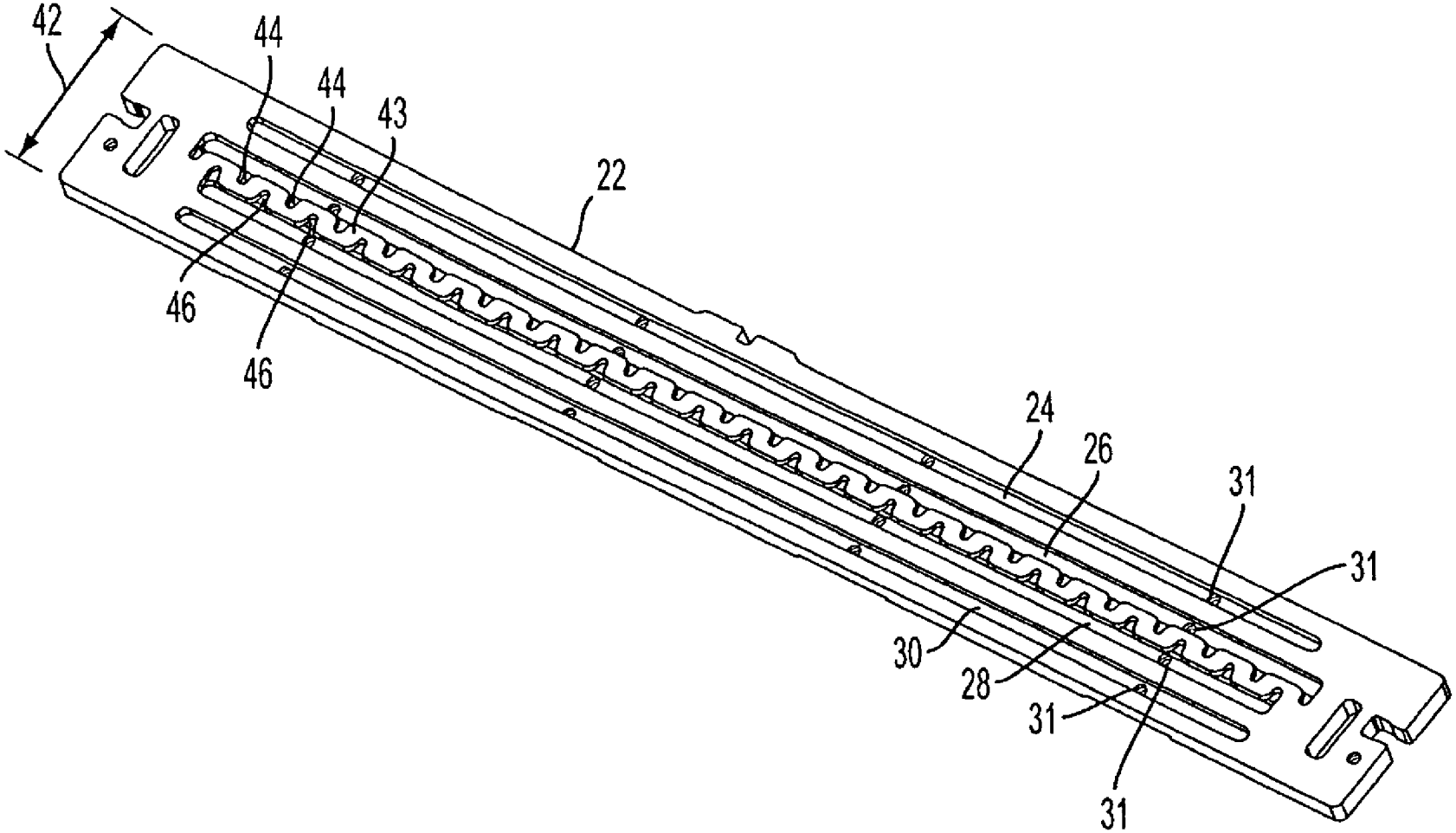
FIG. 1 is a perspective view of an external ink manifold according to the description below.

FIG. 1 is a perspective view of a manifold body 22. The ink manifold chambers 24, 26, 28, 30 replace the ink manifolds that would otherwise be internally within a jet stack. By moving the ink manifolds out from being internal to the jet stack, fewer plates are needed to construct the jet stack.

Figure 2:
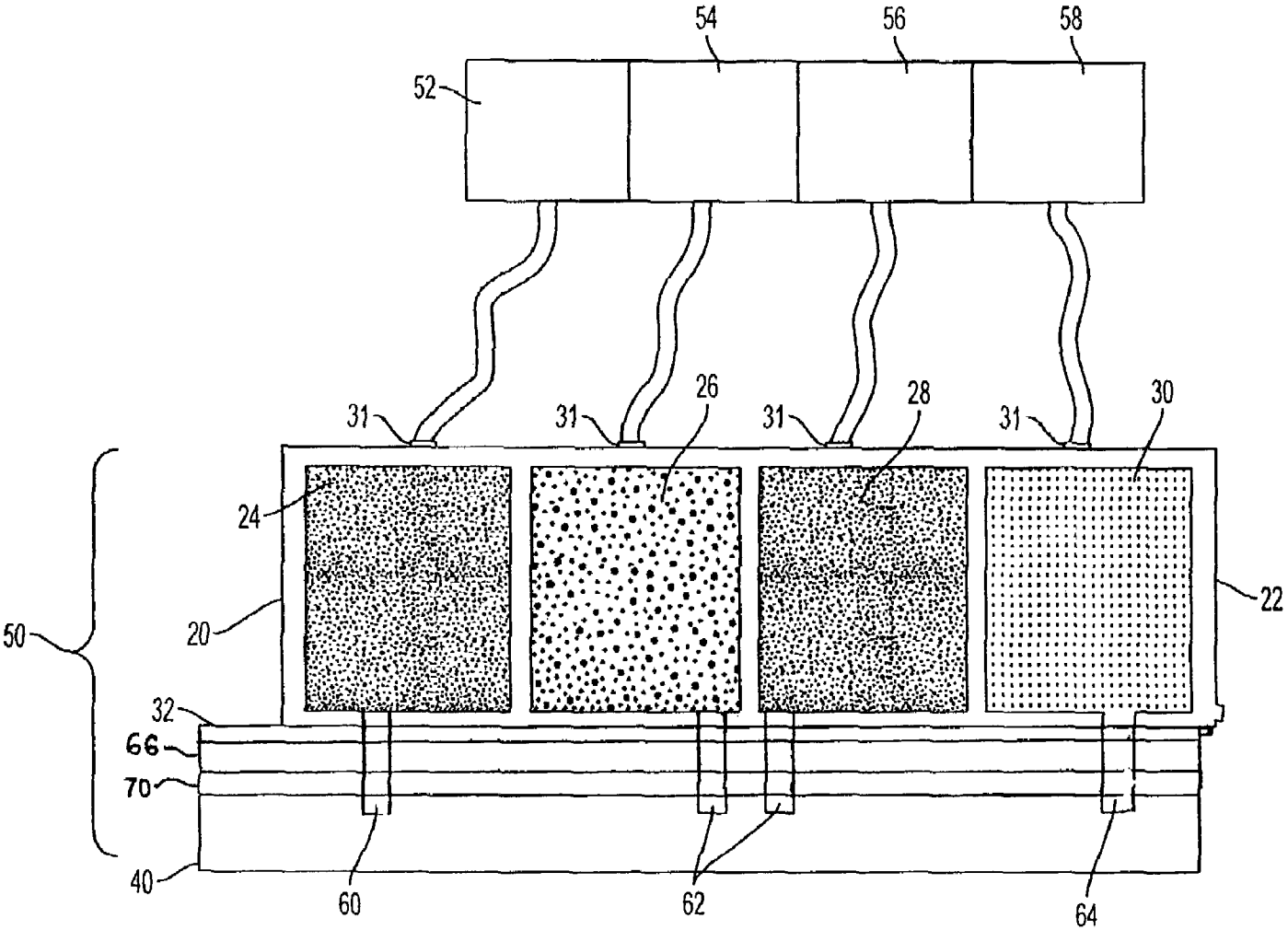
FIG. 2 is a schematic representation of a printhead showing an external ink manifold affixed to a jet stack according the description below.

FIG. 2 is a not-to-scale stylized schematic representation of an end view of printhead 50 using jet stack 40 and external ink manifold 20. The jet stack 40 has a plurality of stacked plates. The external ink manifold 20, shown enlarged to more easily understand their placement, is in fluid communication with the ink reservoirs 52, 54, 56, 58 through ports 31.

Figure 3:
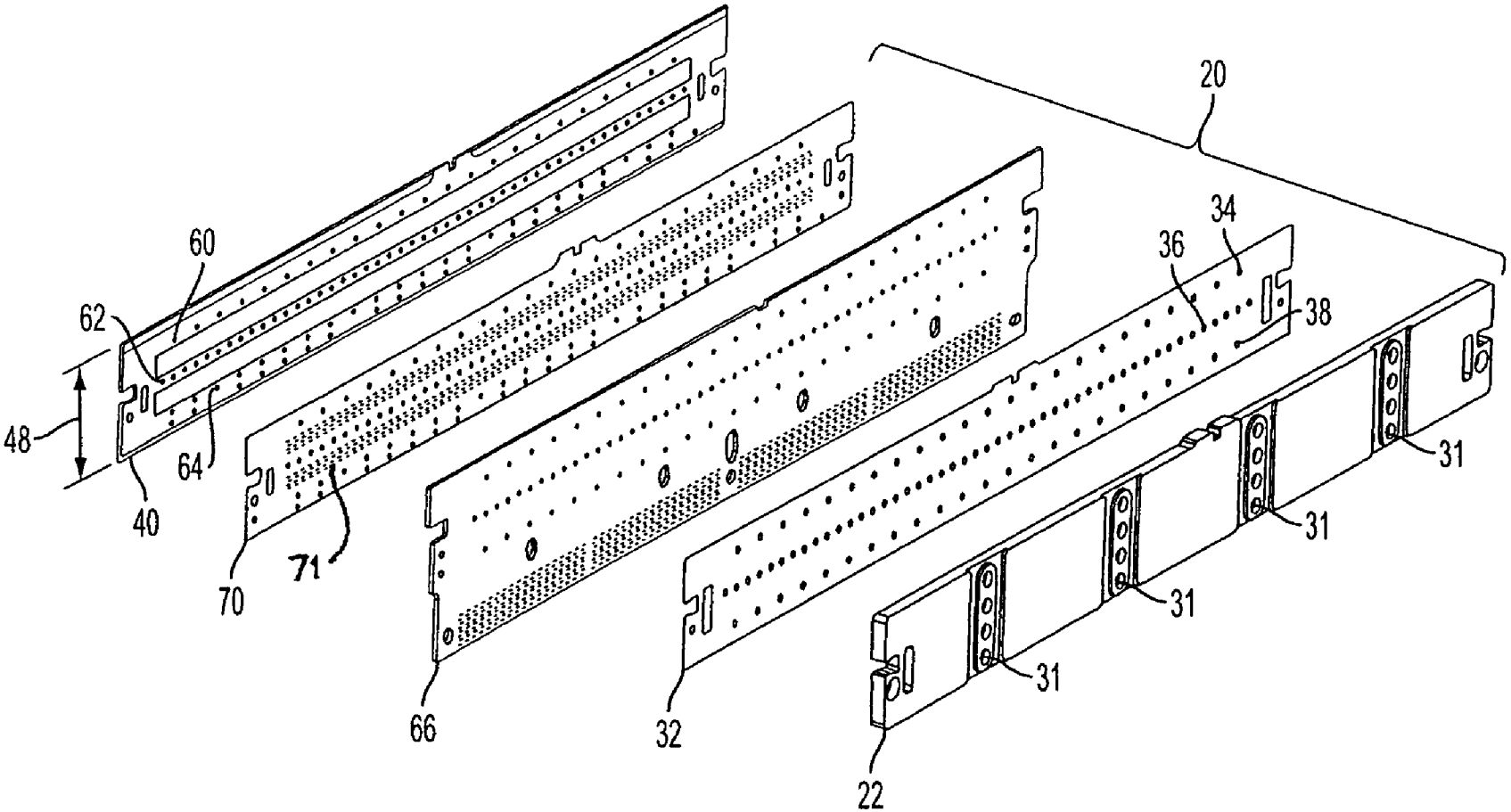
FIG. 3 is an exploded perspective view of the external ink manifold and the jet stack according to the description below.

FIG. 3 is an exploded perspective view of the manifold body 22, adhesive layer 32 and jet stack 40. FIG. 3 shows an opposite side of the manifold body 22 than is shown in FIG. 1, here showing the ports 31 that receive ink from the ink reservoirs 52, 54, 56, 58, shown in FIG. 2. As shown here, the adhesive layer 32 may sandwich a circuit board 66 with another adhesive layer 70.

Referring to FIGS. 1-3, each of the four ink manifold chambers 24, 26, 28, 30 include ports 31 arranged to connect the chambers to one or more ink reservoirs 52, 54, 56, 58. An adhesive layer 32 overlies and seals the four ink manifold chambers 24, 26, 28, 30. The adhesive layer 32 includes a plurality of ports 34, 36, 38 arranged to connect the manifold chambers to a jet stack 40 and fluidly communicate ink from the ink manifold chambers to the jet stack.

While current jet stacks include a plurality of plates to form the ink manifolds, manifold body 22 may be made from a single contiguous material. The manifold body 22 may be made from machined stainless steel, machined aluminum, cast aluminum or plastic. The cost of manufacturing the single contiguous material is less than the cost of manufacturing and brazing together multiple etched and gold-plated stainless steel plates, as is currently done.

The ink manifold chambers 24, 26, 28, 30 are generally longitudinal chambers arrayed across the width 42 of the manifold body 22. The middle two chambers 26, 28 may include a wall 43 between alternating portions 44, 46 that extend toward each other arrayed across the length of the pair of chambers. The alternating portions 44, 46 allow for a single row of ports 36 to be used on adhesive layer 32, as shown in FIG. 3, to communicate the ink in the middle pair of chambers 26, 28 to the jet stack 40. By using a single row of ports 36, less space is used across the width 48 of the jet stack 40.

The external ink manifold 20 overlies the jet stack 40 and is in fluid communication with a plurality of inlet ports 60, 62, 64 on top of the jet stack 40. Two ports 62 are shown stylized depiction in FIG. 2 to emphasize that the middle chambers 26, 28 communicate with the jet stack 40. As shown in FIG. 3, the ports 62 are arrayed in a single line across a middle of the jet stack 40.

Each of the ink manifold chambers 24, 26, 28, 30 contains a separate color of ink respectively supplied by ink reservoirs 52, 54, 56, 58.

Adhesive layer 32 is positioned between the manifold body 22 and the jet stack 40. The adhesive layer 32 bonds the external manifold 20 to the jet stack 40. The adhesive layer 32 includes first adhesive layer 32, circuit board 66 and second adhesive layer 70. The circuit board 66 is sandwiched between the adhesive layers 32, 70 and provides electrical signals for actuation of the jet stack 40. Second adhesive layer 70 includes conductive paths 71 that provide an electrical path between contact pads (not shown) on a bottom of the circuit board 66 and actuators (not shown) on the jet stack 40. Actuators generally may be a heater, a piezoelectric actuator (PZT) or a micro-electromechanical membrane. All of these actuators need an electrical contact which is provided by circuit 66 and lower adhesive layer 70.

Because the external ink manifold 20 is removed from the jet stack 40, more direct paths are used within the jet stack to communicate the ink from the ink manifold 20 to the inkjets in the jet stack 40. These more direct paths reduce the drag on the ink as it moves through the jet stack allowing for an increase in mass flow and firing frequency.

The jet stack 40 has a plurality of stacked plates including a top plate that has a plurality of rows of inlet ports 60, 62, 64. The jet stack 40 is shown here as a single body to simplify the drawing. Because the ink manifold 20 is removed from the jet stack 40, the jet stack 40 may be made from six or seven stacked plates instead of sixteen or more stacked plates thereby reducing the cost of the jet stack 40 and thus the overall cost of the printhead 50 shown in FIG. 2.

In FIG. 3, three rows of inlet ports 60, 62, 64 are shown on jet stack 40. More or fewer rows, however, are contemplated to be encompassed by the description herein. The three rows of inlet ports 60, 62, 64 extend across the length of the top plate 66 with the middle row 62 extending across a central portion of the top plate 66.

Thus, the first row of inlet ports 60 connects a first color of ink from ink manifold chamber 24 to a first set of inkjets. The third row of inlet ports 64 connects a fourth color of ink from the ink manifold chamber 30 to a second set of inkjets. Alternating ports in the middle row of inlet ports 62 connect second and third colors of inks respectively from middle pair of chambers 26, 28 to third and fourth sets of inkjets.

It will be appreciated that various of the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

What is claimed is:

1. An inkjet printhead comprising:

a plurality of stacked plates forming a jet stack, in which the plurality of stacked plates includes a top plate having a three rows of inlet ports with each row extending across a length of the top plate that connect to a plurality of ink jets in the jet stack, in which aligned cavities in intervening plates are arranged such that a first row of inlet ports are connected with a first set of inkjets, a third row of inlet ports are connected with a second set of inkjets and alternating inlet ports in a middle row of inlet ports are respectively connected to a third and a fourth set of inkjets; and an external ink manifold in fluid communication with an ink reservoir and in fluid communication with the plurality of rows of inlet ports in the top plate.

2. The inkjet printhead of claim 1, in which the external manifold comprises:

a manifold body having a plurality of ink chambers and ports arranged for connecting the ink chambers to respective ink reservoirs; and an adhesive layer having a plurality of ports for connecting the ink chambers to the jet stack, the adhesive layer overlying and sealing the ink chambers.

3. The inkjet printhead of claim 2, in which the manifold body comprises a single contiguous material.

4. The inkjet printhead of claim 3, in which the manifold body comprises a material selected from the group consisting of machined stainless steel, machined aluminum, cast aluminum and plastic.

5. The inkjet printhead of claim 2, in which the adhesive layer bonds the manifold body to the jet stack and seals the manifold body.

6. The inkjet printhead of claim 2, in which a pair of ink chambers are each in fluid communication with alternating inlet ports in the middle row of inlet ports.

7. The inkjet printhead of claim 1, in which the plurality of rows of inlet ports in the top plate are arranged across a central portion of the top plate.

8. The inkjet printhead of claim 1, in which the plurality of stacked plates is six or seven stacked plates.

* * * * *

UNITED STATES PATENT AND TRADEMARK OFFICE

CERTIFICATE OF CORRECTION

PATENT NO. : 7,600,863 B2
APPLICATION NO. : 11/326030
DATED : October 13, 2009
INVENTOR(S) : Jonathan Robert Brick et al.

It is certified that error appears in the above-identified patent and that said Letters Patent is hereby corrected as shown below:

On the Title Page: Item (75) Inventors: Chad Johan --Stenes-- should read: Chad Johan "Slenes"

Signed and Sealed this
Sixteenth Day of July, 2013

Teresa Stanek Rea
*Acting Director of the United States Patent and Trademark Office*